US007419755B2

(12) United States Patent
Maniar et al.

(10) Patent No.: US 7,419,755 B2
(45) Date of Patent: Sep. 2, 2008

(54) CARRIER COMPOSITION

(75) Inventors: Deepak R. Maniar, Webster, NY (US); Thomas C. Dombroski, Rochester, NY (US); Christopher M. Pattison, Rochester, NY (US); Bernard A. Kelly, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 11/159,035

(22) Filed: Jun. 22, 2005

(65) Prior Publication Data

US 2006/0292478 A1 Dec. 28, 2006

(51) Int. Cl.
*G03G 9/00* (2006.01)

(52) U.S. Cl. ..... 430/111.35; 430/111.1

(58) Field of Classification Search ..... 430/111.35, 430/111.1

See application file for complete search history.

(56) References Cited

U.S. PATENT DOCUMENTS 3,590,000 A 6/1971 Palermiti et al.
3,658,500 A 4/1972 Hagenbach
3,664,300 A 5/1972 Joseph
3,764,310 A 10/1973 Hagenbach
3,849,127 A 11/1974 Madrid et al.
3,850,676 A 11/1974 Madrid et al.
3,857,792 A 12/1974 Madrid et al.
4,233,387 A 11/1980 Mammino et al.
4,264,697 A 4/1981 Perez et al.
4,265,990 A 5/1981 Stolka et al.
4,287,287 A 9/1981 Bolte et al.
4,294,904 A 10/1981 Mammino
4,298,672 A 11/1981 Lu
4,338,390 A 7/1982 Lu
4,368,970 A 1/1983 Hays
4,394,429 A 7/1983 Hays
4,563,406 A 1/1986 Ohbayashi et al.
4,563,407 A 1/1986 Matsui et al.
4,584,253 A 4/1986 Lin et al.
4,585,884 A 4/1986 Lin et al.
4,859,558 A 8/1989 Matsumura et al.
4,935,326 A 6/1990 Creatura et al.
4,937,166 A 6/1990 Creatura et al.
5,015,550 A 5/1991 Creatura et al.
5,155,000 A 10/1992 Matsumura et al.
5,204,204 A * 4/1993 Shintani et al. ..... 430/111.35
5,236,629 A 8/1993 Mahabadi et al.
5,518,855 A 5/1996 Creatura et al.
5,567,562 A 10/1996 Creatura et al.
5,928,830 A 7/1999 Cheng et al.

(Continued)

OTHER PUBLICATIONS

The Condensed Chemical Dictionary, eighth edition, Gessner G. Hawley, 1971, p. 548.*

*Primary Examiner*—Mark A Chapman
(74) *Attorney, Agent, or Firm*—Eugene O. Palazzo; Fay Sharpe LLP

(57) ABSTRACT

Carrier particles comprise a core and a polymer coating that comprises a mixture of polymethyl methacrlyate (PMMA) and melamine. The coating compositions comprise from about 60 to about 80 percent by weight of PMMA and from about 20 to about 40 percent by weight of melamine. The carriers may be combined with a toner to provide a developer suitable for use in an electrostatographic process. Carriers comprising the PMMA/melamine coatings exhibit increased triboelectric charging, a more conductive carrier, and also contribute to reducing toner cohesion.

6 Claims, 2 Drawing Sheets

U.S. PATENT DOCUMENTS 6,042,981 A 3/2000 Barbette et al.
6,083,652 A 7/2000 Duggan et al.
6,245,474 B1 6/2001 Hsu et al.
6,500,595 B1 * 12/2002 Mochizuki et al. ..... 430/111.1
6,511,780 B1 1/2003 Veregin et al.
6,764,799 B2 7/2004 Skorokhod et al.
2002/0022190 A1 * 2/2002 Iizuka et al. ..... 430/110.4
2003/0235773 A1 12/2003 Skorokhod et al.
2004/0137352 A1 7/2004 Mc Stravick et al.
2005/0031979 A1 2/2005 Mc Stravick et al.
2005/0064194 A1 3/2005 Kumar et al.
2005/0250030 A1 * 11/2005 McStravick et al. ..... 430/108.6

* cited by examiner

CARRIER COMPOSITION

BACKGROUND

The present disclosure relates, in various embodiments thereof, to coated carrier particles. More specific, the disclosure relates to carrier particle having a coating that comprises polymethyl methacrylate and melamine. The carriers are suitable for use in developer compositions, which are suitable for use in imaging processes such as electrostatographic processes.

The electrostatographic process, and particularly the xerographic process, is known. This process involves, for example, the formation of an electrostatic latent image on a photoreceptor, followed by development of the image with a developer, and subsequent transfer of the image to a suitable substrate. Numerous different types of xerographic imaging processes are known wherein, for example, insulative developer particles or conductive developer particles are selected depending on the development systems used. Moreover, of interest with respect to the aforementioned developer compositions is the appropriate triboelectric charging values associated therewith, as it is these values that may enable continued formation of developed images of high quality and excellent resolution. In two component developer compositions, carrier particles are used in charging the toner particles.

Carrier particles in part are comprised, for example, of a roughly spherical or irregular shape core, often referred to as the "carrier core," that may be generated from a variety of materials or purchased. The core is typically coated with a resin, such as a polymer or copolymer, and which resin may contain a conductive component, such as certain carbon blacks, to, for example, provide carrier particles with more desirable and consistent triboelectric properties. Including conductive components in the carrier coating may be disadvantageous in some instances, because it can, for example, be difficult and costly to blend the core and conductive component, and also the conductive component may not fully serve its purposes. For example, processes to incorporate conductive material into carrier coating include the use of electrostatic attraction, mechanical impaction, in situ polymerization, dry blending, thermal fusion and others, and which processes often result in only minimal amounts of conductive material being incorporated into the coating or generate conductive carrier coatings too large for effective and efficient use especially with smaller sized carriers. Additionally, dry blending processes and other mixing to incorporate the carbon black or other conductive material into the polymer coating can be selected. To avoid or minimize transfer of the carbon black from the polymer coating, however, the amount of carbon black that may be blended may be limited, for example, to 20 percent by weight or less, which limits the conductivity achievable by the resultant conductive polymer. Also, the carbon black from the carrier coating polymer can contaminate the toner resulting in changes in both charging performance and color of the toner, such as for example, a light colored toner, such as yellow.

In addition to the problems associated with loading conductive materials into coating resins, recent efforts to advance carrier particle science have focused on the attainment of conductive coatings for carrier particles to improve development quality and provide particles that can be recycled and that do not adversely affect the imaging member in any substantial manner. Many coatings can deteriorate rapidly, especially when selected for a continuous xerographic process where the entire coating may separate from the carrier core in the form of chips or flakes causing failure upon impact or abrasive contact with machine parts and other carrier particles. These flakes or chips, which cannot generally be reclaimed from the developer mixture, have an adverse effect on the triboelectric charging characteristics of the carrier particles, thereby providing images with lower resolution in comparison to those compositions wherein the carrier coatings are retained on the surface of the core substrate.

A further problem encountered with some prior art carrier coatings resides in fluctuating triboelectric charging characteristics, particularly with changes in relative humidity. High relative humidity hinders image density in the xerographic process may cause background deposits, lead to developer instability, and may result in an overall degeneration of print quality. In the science of xerography, the term "A Zone" refers, for example, to hot and humid conditions, the term "C Zone" refers, for example, to cold and dry conditions. Triboelectric charges are usually lower in the "A Zone" than in the "C Zone." It is desirable to have the measured triboelectric charges (tribo) for a particular carrier in the A Zone and the C Zone, when entered into a ratio of A zone tribo /C zone tribo to be close to about 1 to obtain development in high humidity.

The use of powder coating processes has been a focus to coat carrier particles. Powder coating processes typically select polymers in the form of fine powders which can be mixed with a carrier core. The triboelectric charging value of the aforementioned carriers can be controlled by the polymer or mixture of polymers selected for the coating. But only a limited number of polymers are available in the form of fine powders, especially for the preparation of conductive carriers. Conductive polymers, which are in the form of fine powder, can be utilized as carrier coatings, for example a conductive carbon black loaded polymer, reference U.S. Pat. No. 5,236,629, the disclosure of which is totally incorporated herein by reference. Also, the carrier coating in some instances tend to chip or flake off, and fail upon impact, or abrasive contact with machine parts and other carrier particles. These flakes or chips, which cannot usually be readily reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days, and poor stability.

A carrier coating commonly used is a polymethyl methacrylate (#MP-116 PMMA) available from Soken Chemical of Japan. This powder typically has a diameter of about 0.4 to 0.5 micrometer and it can be generated from polymethyl methacrylate. Usually, high amounts of PMMA are selected to coat a 30 to 50 micrometer carrier core and achieve a surface area coverage of about 85 to 95 percent on the carrier. The use of such high amounts of carrier coating often results in lower carrier yields because, for example, of the formation of fused aggregates. Fused aggregates usually need to be broken up or removed by screening. Crushing or breaking up of the aggregates may result in weak or "chipped off" areas on the carrier surface potentially causing poor coating quality. Screen separation may result in a lower yield as aggregates are removed from the final product.

Carrier particles for use in the development of electrostatic latent images are described in many patents including, for example, U.S. Pat. No. 3,590,000. These carrier particles may consist of various cores, including steel, with a coating thereover of fluoropolymers and terpolymers of styrene, methacrylate, and silane compounds.

There is illustrated in U.S. Pat. No.4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 450° F. for a period of about 20 minutes to about 60 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics. Further, in regard to U.S. Pat. No.4,233,387, it is believed that only certain triboelectric charging values can be generated when certain conductivity values or characteristics are contemplated.

U.S. Pat. No. 4,937,166, the disclosure of which is totally incorporated herein by reference, describes a carrier composition comprised of a core with a coating thereover comprised of a mixture of first and second polymers that are not in close proximity thereto in the triboelectric series. The core is described to be iron, ferrites, steel or nickel. The first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate. The particles are described to, for example, possess a triboelectric charging value of from about −5 to about −90 microcoulombs per gram.

U.S. Pat. No. 4,935,326, the disclosure of which is totally incorporated herein by reference, discloses a carrier and developer composition, and a process for the preparation of carrier particles with substantially stable conductivity parameters that comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidene fluoride and polyethylene; polymethyl methacrylate and copolyethylene vinyl acetate; copolyvinylidene fluoride tetrafluoroethylene and polyethylenes; copolyvinylidene fluoride tetrafluoroethylene and copolyethylene vinyl acetate; and polymethyl methacrylate and polyvinylidene fluoride.

U.S. Pat. No. 5,567,562, the disclosure of which is totally incorporated herein by reference, describes a process for the preparation of conductive carrier particles which comprises mixing a carrier core with a first polymer pair and a second polymer pair, heating the mixture, and cooling the mixture, wherein the first and second polymer pair each contain an insulating polymer and a conductive polymer, and wherein the carrier conductivity thereof is from about $10^{-6}$ to about $10^{-14}$ (ohm-cm)$^{-1}$. The first polymer pair is preferably comprised of an insulating polymethyl methacrylate and a conductive polymethyl methacrylate, and the second polymer pair is preferably comprised of an insulating polyvinylidene fluoride and a conductive polyvinylidene fluoride.

There are illustrated in U.S. Pat. No. 6,042,981, the disclosure of which is totally incorporated herein by reference, carriers including a polymer coating wherein the polymer coating may contain a conductive component, such as carbon black, and which conductive component is preferably dispersed in the polymer coating. The conductive component is incorporated into the polymer coating of the carrier core by combining the carrier core, polymer coating, and the conductive component in a mixing process such as cascade roll mixing, tumbling, milling, shaking, electrostatic powder cloud spraying, fluidized bed, electrostatic disc processing or by an electrostatic curtain. After the mixing process, heating is initiated to coat the carrier core with the polymer coating and conductive component.

There are illustrated in U.S. Pat. No. 5,928,830, the disclosure of which is totally incorporated herein by reference, processes for the preparation of black and color toner compositions. This toner is prepared from latex comprised of a polymer core and a polymer shell thereover. The latex is fused or coalesced together forming toner particles comprised of an aggregation of the latex. Conductive or pigment components may be incorporated into the latex cores/shell prior to coalescence by blending a dispersion of the conductive or pigment component in a cationic surfactant with the latex core/shell in an ionic or nonionic surfactant. Specific examples of conductive components incorporated in U.S. Pat. No. 5,928,830 include conductive carbon black SC Ultra available from Conductex Inc. and antimony-doped tin oxide Zelec ECP3005-XC manufactured by E. I. DuPont.

In view of the foregoing, there is a need for coated carrier particles having high triboelectric charging characteristics. There is also a need for coated carrier particles having high conductivities. Further, there is a need for a coating composition that exhibits high coating coverage of relatively low coating loadings.

BRIEF DESCRIPTION

The present disclosure provides, in various embodiments thereof, a carrier comprising a core particle and a coating disposed on the core particle, the coating comprising from about 60 to about 80 percent by weight of polymethyl methacrylate and from about 20 to about 40 percent by weight of melamine.

The percent disclosure also provides, in various embodiments thereof, a developer comprising toner and a carrier, the carrier comprising a core and a coating disposed over the core, wherein the coating comprises from about 60 to about 80 percent by weight of polymethyl methacrylate and from about 20 to about 40 percent by weight of melamine.

These and other non-limiting features and characteristics of a carrier are described in greater detail herein.

BRIEF DESCRIPTION OF THE DRAWINGS

The following is a brief description of the drawings, which are presented here for purposes of illustrating various aspects of embodiments of the present disclosure and not to be limiting features thereof.

DETAILED DESCRIPTION

Figure 1:
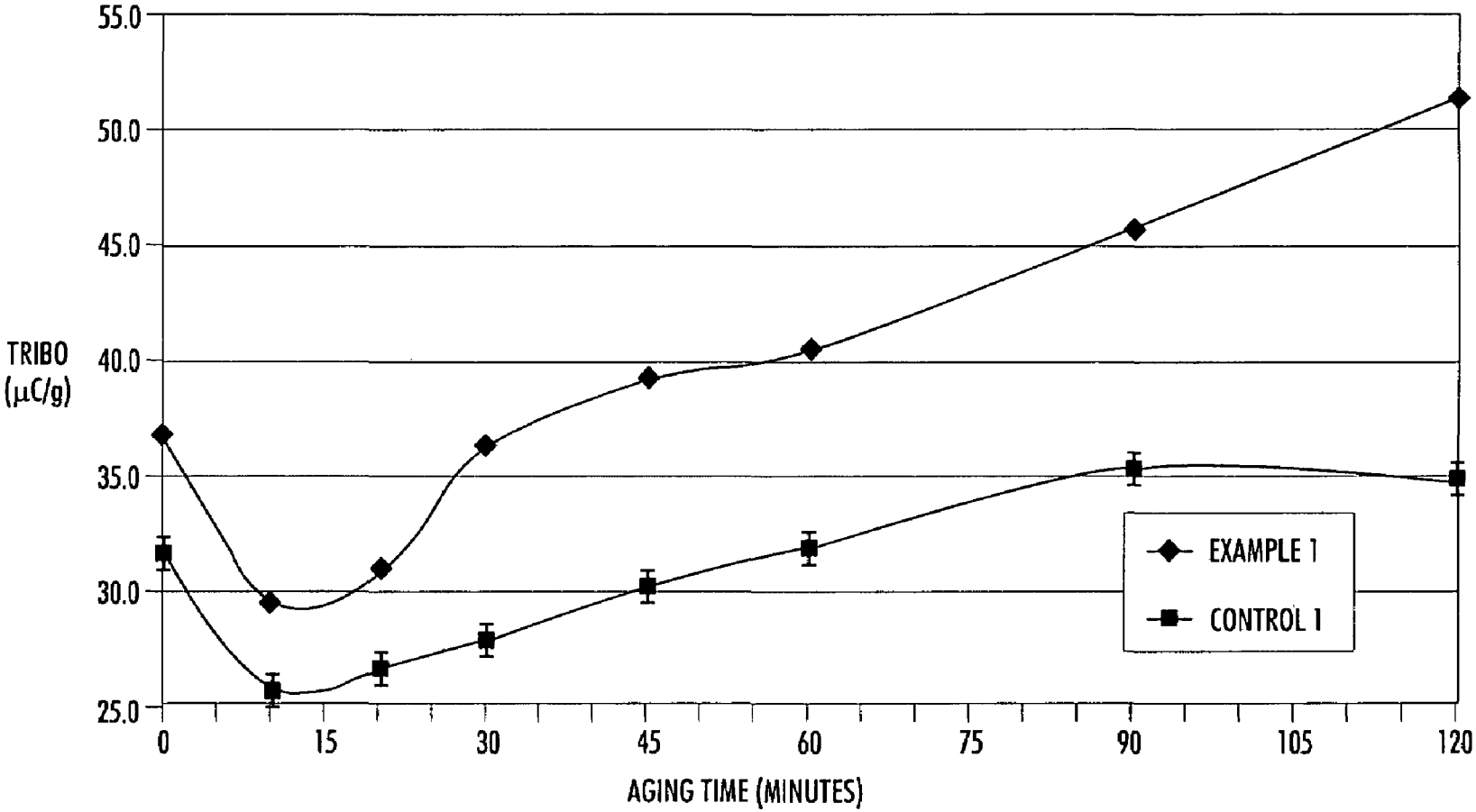
FIG. 1 is a graph comparing the effect of aging on the triboelectric charge of control carrier particles and carrier particles comprising PMMA/melamine coatings.

A carrier in accordance with the present disclosure comprises a core (core particle) coated with a coating composition that comprises a mixture of polymethyl methacrylate (PMMA) and melamine. The coating composition contains a relatively high amount of melamine.

The core particle may be selected from any suitable solid carrier core materials. The core preferably should possess properties that will enable the toner particles to acquire a positive charge or a negative charge, and that will permit desirable flow properties in the developer reservoir present in the xerographic imaging apparatus. Other carrier core properties that may be considered in selecting the core material include, for example, suitable magnetic characteristics that will permit magnetic brush formation in mag brush development processes. The core should also preferably possess desirable mechanical aging characteristics.

Examples of carrier cores that may be selected include, but are not limited to, iron, steel, ferrites, magnetites, nickel, and mixtures thereof. In one embodiment, the carrier cores are magnetite. In another embodiment, the carrier cores are steel. The core particles may have an average particle diameter of from about 50 to about 80 microns, as determined by standard laser diffraction techniques. In embodiments, the core particles have an average diameter of from about 60 to about 70 microns. In embodiments, the core particles may individually have a magnetic saturation of 180 to 200 emu/g, a coercivity of 20 to 30 Oer, and a retentivity of 1.0 to 5.0 emu/g. In addition, (steel) core particles may have a powder density as determined by ASTM Test B-212-99 of 2.35 to 2.75 g/cm$^3$, a conductivity of $1.5\times10^{-7}$ to $1.5\times10^{-9}$ (ohm cm)$^{-1}$, and a breakdown voltage of 30 to 50 V. The conductivity of the core is measured by applying a 10 V fixed voltage across a 0.1 inch magnetic brush in a static (non-rotating) mode. The resultant current flow through the material is used to calculate the conductivity of the core. The voltage breakdown of the core is measured by applying a fixed rate of increasing voltage across 0.1 inch magnetic brush while under rotation. The applied voltage at which 100 microamps of current flows through the samples is defined as the breakdown voltage.

The carrier cores are coated with a coating composition comprising a mixture of polymethyl methacrylate (PMMA) and melamine. In embodiments, the coating composition comprises polymethyl methacrylate in an amount of from about 60 to about 80 percent by weight of the coating and melamine in an amount in an amount of from about 20 to about 40 percent by weight of the coating. In one embodiment, the coating composition comprises about 80 percent PMMA and about 20 percent melamine. In another embodiment, the coating composition comprises about 60 percent PMMA and about 40 percent melamine.

A non-limiting example of a suitable PMMA material is a polymethyl methacrylate (#MP-116 PMMA) available from Soken Chemical of Japan. Other examples of materials suitable for use as the PMMA component include, but are not limited to, SLS PMMA, Soken MP-1451 (small size), different Molecular Weight PMMAs, eeonomer and other acrylic polymers and combinations thereof.

Examples of materials suitable for use as the melamine component include, but are not limited to melamine formaldehyde resin and any derivatives of such resins.

The carrier has a coating weight, in embodiments, of less than about 1.0 percent by weight of the carrier. In other embodiments, the coating weight is less than about 0.5 percent by weight of the carrier. In still further embodiments, the coating weight is from about 0.35 to about 0.5 percent by weight of the carrier.

Various effective suitable means can be used to apply the coating materials to the surface of the carrier core particles. Examples of typical means for this purpose include, but are not limited to, combining the carrier core material and the PMMA/melamine mixture by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the carrier core remain uncoated or exposed, the carrier particles will possess electrically conductive properties when the core material comprises a metal. For example, the mixture of carrier core particles and PMMA/melamine materials may be heated to a temperature of between from about 200° F. to about 650° F., for a period of time of from, for example, about 10 minutes to about 60 minutes, enabling the PMMA and melamine materials to melt and fuse to the carrier core particles. The coated carrier particles are then cooled and thereafter classified to a desired particle size.

Developer composition may be prepared by combining a PMMA/melamine coated carrier particle with a toner. The toner is not limited and may be selected as desired for a particular purpose or intended use. Illustrative examples of finely divided toner resins suitable for the developer compositions include, but are not limited to, polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, crosslinked polyesters, and the like. Specific examples of suitable vinyl monomers include styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N- vinyl indole, N-vinyl pyrrolidone; and the like. Also, there may be selected styrene butadiene copolymers, mixtures thereof, and the like.

As one toner resin there can be selected the esterification products of a dicarboxylic acid and a diol comprising a diphenol, reference U.S. Pat. No. 3,590,000, the disclosure of which is totally incorporated herein by reference. Other suitable toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol, and reactive extruded polyesters.

Generally, a developer comprises from about 1 part to about 5 parts by weight of toner particles mixed with from about 10 to about 300 parts by weight of carrier particles in accordance with the present disclosure. Of course, developer compositions with mixtures outside these ranges are also possible.

Numerous well known suitable colorants, such as pigments or dyes, can be selected as the colorant for the toner including, for example, cyan, magenta, yellow, red, blue, carbon black, nigrosine dye, lamp black, iron oxides, magnetites, and mixtures thereof. The toner colorant should be present in a sufficient amount to render the toner composition colored. Thus, the colorant particles can be present in amounts of from about 3 percent by weight to about 20 percent by weight, and preferably from about 3 to about 12 weight percent or percent by weight, based on the total weight of the toner composition, although, lesser or greater amounts of colorant particles can be selected. Colorant includes pigment, dye, mixtures thereof, mixtures of pigments, mixtures of dyes, and the like. Specific colorant examples are colored pigments, dyes, and mixtures thereof including, but not limited to, carbon black, such as REGAL 330® carbon black (Cabot Corporation), Acetylene Black, Lamp Black, Aniline Black, Chrome Yellow, Zinc Yellow, Sicofast Yellow, Sunbrite Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as MAPICO Black (Columbia), NP608 and NP604 (Northern Pigment), Bayferrox 8610 (Bayer), M08699 (Mobay), TMB-100 (Magnox), mixtures thereof and the like.

The colorant, for example, black, cyan, magenta and/or yellow colorant is incorporated in an amount sufficient to impart the desired color to the toner. In general, the pigment or dye is selected in an amount of from about 2 to about 60 percent by weight, and preferably from about 2 to about 9 percent by weight for a color toner and about 3 to about 60 percent by weight for black toner.

For the cyan toner, the toner should contain a suitable cyan pigment and loading so as to enable a broad color gamut similar to that achieved in benchmark lithographic four-color presses. In embodiments, the cyan pigment is comprised of 30 percent PV FAST BLUE® (Pigment Blue 15:3) obtained from SUN Chemicals dispersed in a 70 percent linear propoxylated bisphenol A fumarate and is loaded into the toner in an amount of about 11 percent by weight (corresponding to about 3.3 percent by weight pigment loading). For the yellow toner, the toner should contain a suitable yellow pigment type and loading so as to enable a color gamut as similar to that achieved in benchmark lithographic four- color presses. The pigment can be comprised of 30 percent Sunbrite Yellow (Pigment Yellow 17) obtained from SUN Chemicals dispersed in 70 percent of a linear propoxylated bisphenol A fumarate and is loaded into the toner in an amount of about 27 percent by weight (corresponding to about 8 percent by weight pigment loading).

For the magenta toner, the toner should contain a suitable magenta pigment type and loading to provide a broad color gamut. The magenta pigment can be comprised of 40 percent FANAL PINK® (Pigment Red 81:2) obtained from BASF dispersed in 60 percent of a linear propoxylated bisphenol A fumarate and is loaded into the toner in an amount of about 12 percent by weight (corresponding to about 4.7 percent by weight pigment loading).

When the colorant particles are comprised of magnetites, which are a mixture of iron oxides (FeO, $Fe_2O_3$) including those commercially available as MAPICO BLACK®, they are usually present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black, is contained therein, about 90 percent by weight of resin is selected. Generally, the toner composition is comprised of from about 85 percent to about 97 percent by weight of toner resin particles, and from about 3 percent by weight to about 15 percent by weight of colorant particles.

The developer compositions can be comprised of thermoplastic resin particles, carrier particles and as colorants, magenta, cyan and/or yellow particles, and mixtures thereof. More specifically, illustrative examples of magentas include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyans include copper tetra-4(octaecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3- dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4- sulfonanilide phenylazo-4'-chloro-2,5-dimethoxy aceto-acetanilide, permanent Yellow FGL, and the like. The colorants, which include pigments, mixtures of pigments, dyes, mixtures of dyes, mixtures of dyes and pigments, and the like, are generally present in the toner composition in an amount of from about 1 weight percent to about 15 weight percent based on the weight of the toner resin particles.

For further enhancing the positive charging characteristics of the developer compositions illustrated herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88®, naphthalene sulfonates, quaternary ammonium compounds; and other similar known charge enhancing additives. These additives, which can also include waxes, such as polypropylenes, polyethylenes, and the like, and surface additives of colloidal silicas, are usually incorporated into the toner or carrier coating in an amount of from about 0.1 to about 20 percent by weight, and preferably from about. 1 to about 7 weight percent by weight.

The toner composition can be prepared by a number of known methods including melt blending the toner resin particles, and pigment particles or colorants followed by mechanical attrition. Other methods include emulsion aggregates spray drying, melt dispersion, dispersion polymerization and suspension polymerization. In one dispersion polymerization method, a solvent dispersion of the resin particles and the colorant particles are spray dried under controlled conditions to result in the desired product.

Examples of imaging members selected for the imaging processes illustrated herein are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference, for example, U.S. Pat. Nos. 4,265,990; 4,585,884; 4,584,253, and 4,563,406, the disclosures of which are totally incorporated herein by reference, and other similar layered photoresponsive devices. Examples of generating layers are trigonal selenium, metal phthalocyanines, perylenes, titanyl phthalocyanines, metal free phthalocyanines and vanadyl phthalocyanines. As charge transport molecules there can be selected, for example, the aryl diamines disclosed in the '990 patent. Also, there can be selected as photogenerating pigments, squaraine compounds, thiapyrillium materials, hydroxy gallium phthalocyanine, and the like. These layered members are conventionally charged negatively thus usually requiring a positively charged toner. Other photoresponsive members may include pigments of polyvinylcarbazole 4-dimethylamino benzylidene, benzhydrazide, 2-benzylidene-aminocarbazole, 4-dimethylamino-benzylidene, (2-nitro-benzylidene)-p-bromoaniline, 2,4-diphenylquinazoline, 1,2,4-triazine, 1,5-diphenyl-3-methylpyrazoline 2-(4'-dimethylaminophenyl)-benzoaxzole, 3-aminocarbazole, polyvinyl carbazole-trinitrofluorenone charge transfer complex; and mixtures thereof.

Moreover, the developer compositions are particularly useful in electrostatographic imaging processes and apparatuses wherein there is selected a moving transporting means and a moving charging means; and wherein there is selected a deflected flexible layered imaging member, reference, for example, U.S. Pat. Nos. 4,394,429 and 4,368,970, the disclosures of which are totally incorporated herein by reference. Images obtained with the developer composition of the present disclosure in embodiments possessed acceptable solids, excellent halftones and desirable line resolution with acceptable or substantially no background deposits.

Carrier particles coated with a mixture of PMMA and melamine are further described with reference to the following examples. The examples are merely illustrative examples of carriers and not intended to limit the scope of the appended claims in any manner.

EXAMPLES

Carriers were prepared as follows. Coating compositions were prepared by mixing PMMA and melamine in the desired weight ratios in a M5R blender. Coating compositions were prepared using one of SLS PMMA (Examples 1-5, Control 1) and Soken PMMA (Examples 6-7, Control 2). The coating mixtures were then individually mixed with an 80 micron steel core. The coating mixtures were provided in an amount sufficient to provide the desired coating weight. The core and coating mixture was then heat treated in a rotary kiln at about 450° F. to provide the resultant carriers. The compositions of the carriers are displayed in Table 1.

The carriers were then analyzed for triboelectric charge (tribo) and conductivity. The electrical properties of the carriers comprising the PMMA/melamine coating compositions were compared to the electrical properties of a carrier coated with Soken PMMA at a coating weight of 1 percent (Controls 1 and 2), and the electrical properties of an uncoated core. The electrical properties of the carriers are also shown in Table 1.

TABLE 1

| EXAMPLE | PMMA % | MELAMINE | COATING WT. Wt % | C9 TRIBO uC/g | C9 % TC | 30 V. GUT. COND. | $V_B$ |
|---|---|---|---|---|---|---|---|
| 1 | 80 | 20 | 0.35 | 43.51 | 3.93 | 2.97E−08 | 88.2 |
| 2 | 80 | 20 | 0.50 | 40.79 | 3.94 | 4.90E−10 | 92.4 |
| 3 | 80 | 20 | 0.35 | 38.33 | 4.05 | 6.40E−09 | 93.2 |
| 4 | 60 | 40 | 0.35 | 45.31 | 3.95 | 1.65E−08 | 70.6 |
| 5 | 60 | 40 | 0.50 | 52.30 | 4.05 | 6.86E−10 | 93.8 |
| 6 | 80 | 20 | 1.00 | 42.20 | 4.15 | 2.76E−09 | 90.2 |
| 7 | 60 | 40 | 1.00 | 44.50 | 4.19 | 5.95E−09 | 72.4 |
| Control 1 | | | 1.00 | 39.13 | 4.04 | 2.17E−10 | 108.6 |
| Control 2 | 100 | 0 | 1.00 | 42.06 | 4.13 | 3.74E−10 | 106.0 |
| Core | | | 0 | 22.11 | 3.97 | 2.00E−08 | 45.0 |

As shown in Table 1, coating compositions comprising PMMA and melamine with melamine in an amount of from about 20 to about 40 percent by weight of the coating exhibited higher tribo and higher conductivity as compared to the control coatings. Additionally, the carriers comprising the PMMA/melamine coatings exhibited a lower background potential ($V_B$) as compared to the control carriers.

The change of Tribo over time was also examined using the carrier of Example 1 and Control 1. The carriers were tested in a B1 ZTP fixture. The results of this test are shown in FIG. 1. As shown in FIG. 1, the carriers comprising the PMMA/melamine coatings exhibited higher tribo with aging as compared to Control 1 (52 μC/g for the PMMA/melamine carriers as compared to 39 μC/g for the control carriers). These results demonstrate the intrinsic tribo of the carrier coated with the PMMA/melamine coatings.

The effect of the carriers on toner cohesion was also evaluated. It is known that toner cohesivity can have detrimental effects on toner handling and dispensing. Toners with excessively high cohesion, for example, from about 70 percent to about 100 percent as measured with, for example, the method illustrated herein can exhibit "bridging" which prevents fresh toner from being effectively added to the developer mixing system. Conversely, toners with very low cohesion, for example from about 0 percent to about 10 percent, can result in difficulty in controlling toner dispense rates and toner concentration, and can result in excessive dirt in the machine. In addition, in the HSD system, toner particles are first developed from a magnetic brush to two donor rolls. Toner flow should be such that the HSD wires and electric development fields are sufficient to overcome the toner adhesion to the donor roll and enable adequate image development to the photoreceptor. Following development to the photoreceptor, the toner particles should be able to be readily and fully transferred from the photoreceptor to the substrate.

Figure 2:
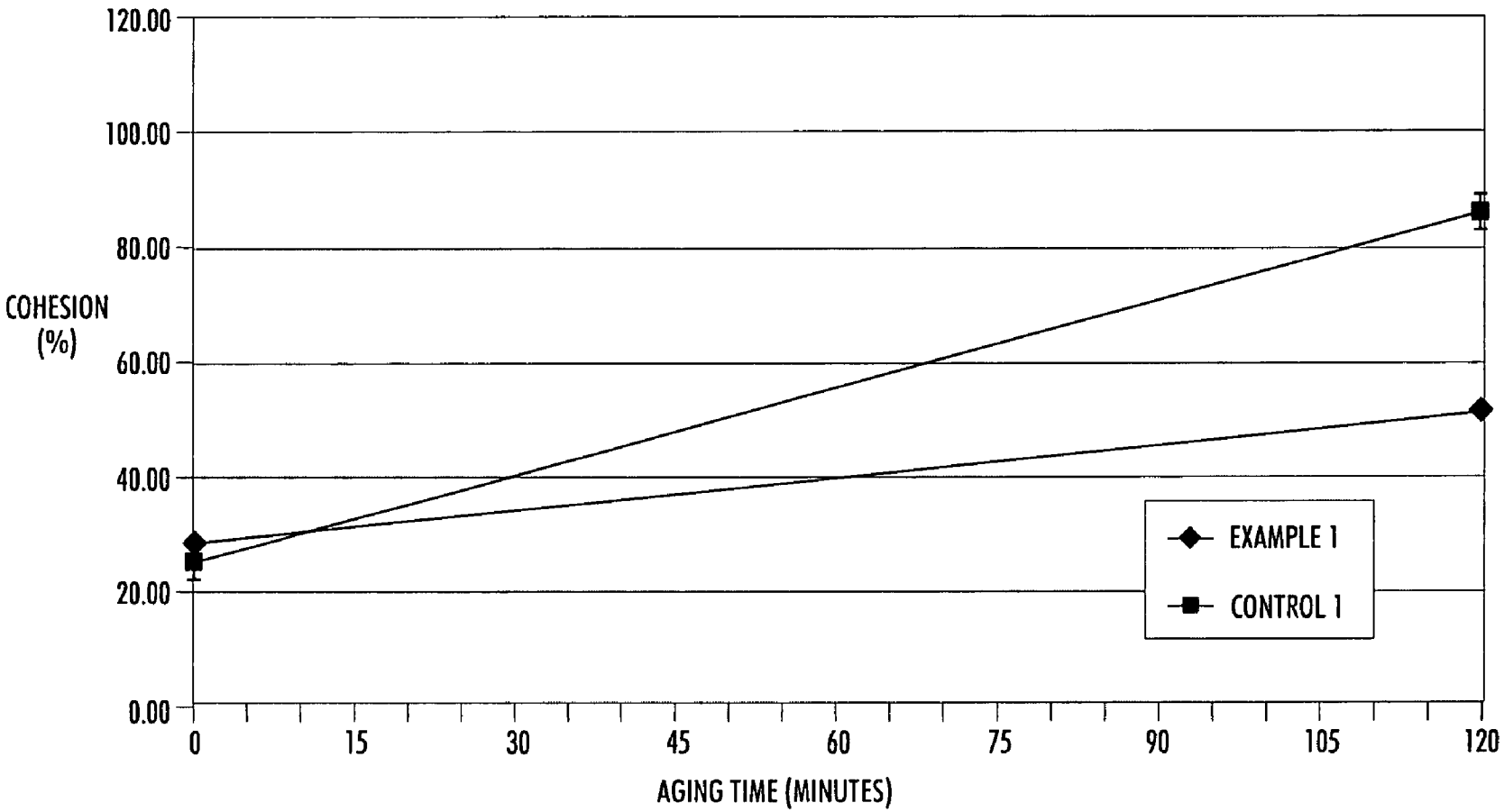
FIG. 2 is a graph comparing toner cohesivity of toners employing a control carrier and a carrier coated with a PMMA/melamine coating.

Toner cohesion was measured by placing a known mass of toner, for example two grams, on top of a set of three screens, for example with screen meshes of about 53 microns, about 45 microns, and about 38 microns in order from top to bottom, and vibrating the screens and toner for a fixed time at a fixed vibration amplitude, for example, for about 90 seconds at a 1 millimeter vibration amplitude. A device to perform this measurement is a Hosokawa Powders Tester, available from Micron Powders Systems. The toner cohesion value is related to the amount of toner remaining on each of the screens at the end of the time. A cohesion value of 100 percent corresponds to all of the toner remaining on the top screen at the end of the vibration and a cohesion value of zero corresponds to all of the toner passing through all three screens, that is, no toner remaining on any of the three screens at the end of the vibration step. The higher the cohesion value, the lesser the flowability of the toner. Minimizing the toner cohesion and adhesion will provide high and stable development and high and uniform transfer. The results are shown in FIG. 2. As shown in FIG. 2, after 120 minutes in the zero thru-put fixture, the toner comprising the control carrier exhibited about 90% cohesion as compared to about 50% using the carrier coated with the PMMA/melamine coating mixture.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A carrier comprising a core particle and a coating disposed on the core particle, the coating consisting of from about 60 to about 80 percent by weight of polymethyl methacrylate and from about 20 to about 40 percent by weight of melamine formaldehyde resin; and the coating being present in an amount of from about 0.35 to about 0.5 percent by weight of the carrier.

2. The carrier according to claim 1, wherein the coating comprises about 80 percent by weight of polymethyl methacrylate and about 20 percent by weight of melamine formaldehyde resin.

3. The carrier according to claim 1, wherein the coating comprises about 60 percent by weight of polymethyl methacrylate and about 40 percent by weight of melamine formaldehyde resin.

4. A developer comprising toner and a carrier, the carrier comprising a core and a coating, wherein the coating consists of from about 60 to about 80 percent by weight of polymethyl methacrylate and from about 20 to about 40 percent by weight of melamine formaldehyde resin; and the coating is present in an amount of from about 0.35 to about 0.5 percent by weight of the carrier.

5. The developer according to claim 4, wherein the coating comprises about 80 percent by weight of polymethyl methacrylate and about 20 percent by weight of melamine formaldehyde resin.

6. The developer according to claim 4, wherein the coating comprises about 60 percent by weight of polymethyl methacrylate and about 40 percent by weight of melamine formaldehyde resin.

* * * * *